US009841190B2

(12) United States Patent
Long

(10) Patent No.: US 9,841,190 B2
(45) Date of Patent: Dec. 12, 2017

(54) GASIFICATION AND PYROLYSIS OPTIMIZATION SYSTEM FOR MEDICAL AND TOXIC WASTE

(71) Applicant: Orion Enterprise International LLC, La Verne, CA (US)

(72) Inventor: Nguyen Gia Long, Ha Noi (VN)

(73) Assignee: ORION ENTERPRISE INTERNATIONAL LLC, La Verne, CA (US)

( * ) Notice: Subject to any disclaimer, the term of this patent is extended or adjusted under 35 U.S.C. 154(b) by 527 days.

(21) Appl. No.: 14/518,279

(22) Filed: Oct. 20, 2014

(65) Prior Publication Data

US 2015/0338092 A1 Nov. 26, 2015

(30) Foreign Application Priority Data

May 22, 2014 (VN) ..... 1 2014-01662

(51) Int. Cl.

| | |
|---|---|
| ***F23G 5/44*** | (2006.01) |
| ***F23G 5/16*** | (2006.01) |
| ***F23G 5/027*** | (2006.01) |
| ***F23G 7/00*** | (2006.01) |
| ***B09B 3/00*** | (2006.01) |

(52) U.S. Cl.

CPC ..... *F23G 5/444* (2013.01); *B09B 3/0075* (2013.01); *B09B 3/0083* (2013.01); *F23G 5/0276* (2013.01); *F23G 5/16* (2013.01); *F23G 7/00* (2013.01); *F23G 2201/303* (2013.01); *F23G 2206/10* (2013.01); *F23G 2209/20* (2013.01)

(58) Field of Classification Search

CPC ..... F23G 5/0273; F23G 5/0276; F23G 5/444; F23G 5/448; F23C 10/28; B09B 3/0075; B02C 19/0075; F23B 90/06; C02F 11/00; C10B 53/00; F23K 3/00; F23K 3/14; F23K 2900/03001

USPC ..... 110/229, 177, 110, 171, 165 R

See application file for complete search history.

(56) References Cited

U.S. PATENT DOCUMENTS 4,206,713 A * 6/1980 Ryason ..... C10B 7/10 110/218

4,738,687 A * 4/1988 Smieskol ..... B01J 3/02 110/171

(Continued)

*Primary Examiner* — Kenneth Rinehart
*Assistant Examiner* — Raymond Williamson
(74) *Attorney, Agent, or Firm* — Myers Wolin, LLC

(57) ABSTRACT

The present disclosure is directed to a treatment system for medical and toxic waste. The system comprises two parts, a heterogeneous gasification system, in which syngas is produced from non-homogeneous waste, and a pyrolysis system, in which medical and hazardous waste are pyrolyzed using the syngas produced from the heterogeneous gasification system. The heterogeneous gasification system comprises a gasifier reactor having a reactor zone connected with an ash distillation zone, a re-fueling structure, an open-top water tank that wraps around the entire bottom section of the gasification system, and a gasification-agent supply module having a supply-end connected to the bottom of the gasifier reactor and a demand-end connected to the pyrolysis system. The pyrolysis system comprises a rotatable pyrolysis reactor having a horizontal and hollow cylindrical shape, a pyrolyzed-ash precipitator, which is connected to the pyrolysis reactor zone, and a condenser connected to the pyrolyzed-ash precipitator.

15 Claims, 6 Drawing Sheets

(56) References Cited

U.S. PATENT DOCUMENTS

| | | | | |
|---|---|---|---|---|
| 5,411,714 | A * | 5/1995 | Wu | C09C 1/482 110/108 |
| 2002/0046686 | A1* | 4/2002 | Sunter | C10J 3/16 110/347 |
| 2009/0084666 | A1* | 4/2009 | Agrawal | C10B 49/22 201/2.5 |
| 2011/0036280 | A1* | 2/2011 | Toase | F23G 5/027 110/235 |
| 2012/0247374 | A1* | 10/2012 | Bender | F23G 5/0276 110/186 |
| 2016/0245508 | A1* | 8/2016 | Massetti | F23G 5/0273 |

* cited by examiner

GASIFICATION AND PYROLYSIS OPTIMIZATION SYSTEM FOR MEDICAL AND TOXIC WASTE

CROSS REFERENCE TO RELATED APPLICATIONS

This application claims priority to Vietnamese Patent Application Serial No. VN 1-2014-01662 filed May 22, 2014, the contents of which are hereby incorporated by reference in their entirety.

FIELD

The present invention relates to gasification and pyrolysis systems for use in the treatment of medical and toxic waste. More specifically, the present invention provides a system that utilizes renewable green energy for pyrolyzing toxic and medical waste in an economical, simple, and safe process using the disclosed system.

BACKGROUND

Gasification and pyrolysis technologies have been deployed for many years in many sectors worldwide.

Today's gasification technology consists of three basic methods: (1) counter-current fixed bed ("up draft") gasification; (2) co-current fixed bed ("down draft") gasification; and (3) entrained flow gasification. All three methods are dependent on the types of feedstock used for the gasification process. That is, all of the current gasification systems that apply the three above methods generally rely on the use of homogenous feed stocks (fuel) such as biomass or coal. None of the gasification systems use a heterogeneous feedstock.

Moreover, these gasification methods of the art are also dependent upon the various characteristics of the feedstock, such as their size, water content, and combustibility. This is particularly so since these methods also depend on the reactor agent, i.e., oxygen, which initiates the combustion. For this reason, the syngas produced from these methods contains unwanted hydrocarbon particles and these hydrocarbon substances break up at higher temperature to produce ash. Therefore, the types of syngas produced in these methods would require complicated filtering subsystems to provide the desired syngas products.

Moreover, the pyrolysis technologies that are currently used in the market require a substantial amount of energy input for the waste treatment, and these applications must overcome serious obstacles when treating medical or toxic waste with a high water content and/or a highly-heterogeneous mixture of materials.

Generally the current pyrolysis methods are considered costly due to high energy usage, and therefore the treatment of toxic waste and medical waste using these methods either is not profitable or may result in economic losses. In addition, current methods of supplying energy to these pyrolyzers are not efficient, since the processes are usually slow (requiring a minimum from 8-12 hours/batch) and fuel costs are high in current market as mentioned above.

For these reasons, high cost and low efficiency, most medical wastes and hazardous wastes are treated with incinerators with 1200° C. or higher, a method that can cause alarming air pollution that can result in serious harm to human health.

Accordingly, there is a need for improved, economically-viable, profitable systems and methods for safe and efficient processing of medical and toxic waste, and, more particularly, for processing of heterogeneous mixtures of such toxic waste materials.

BRIEF SUMMARY

The present disclosure provides a new method and interconnected two-part system to be applied to the pyrolyzing of medical and toxic waste that is highly efficient with respect to energy usage and therefore provides a more profitable pyrolysis system, involving what is referred to herein as a heterogeneous gasification system.

In order to overcome the above-mentioned obstacles and deficiencies of the systems available in the art, the present disclosure provides a two-part system for treating medical waste and hazardous waste which comprises: a heterogeneous gasification system (100) to produce syngas from non-homogeneous waste, and a pyrolysis system (200) for the pyrolyzing of medical and hazardous waste using the syngas produced from the heterogeneous gasification system (100) (see FIGS. 1, 2, and 4)

In one embodiment of the system disclosed herein (see FIGS. 1-6), the heterogeneous gasification system (100) comprises a gasifier reactor (110) that has a vertical rectangular shape which comprises: (a) a gasifier reactor zone (111); connecting with (b) an ash distillation zone (117); (c) a re-fueling structure (120); and (d) a water tank (130) which wraps around the entire bottom section of the gasification system (100). The water tank (130) has a top side open to the air. The gasification system also comprises a gasification-agent supply module (140) with a supply-end connected to the bottom of the gasifier reactor (110) and a demand-end connected to the pyrolysis system (200).

The disclosed two-part system also includes a pyrolysis system (200) that comprises: (a) a pyrolysis reactor (210) with a horizontal and hollow cylindrical shape which is rotatable by a roller (240); (b) a pyrolyzed-ash precipitator (220) which is connected to the pyrolysis reactor zone (210); and (c) condenser (230) connected to the pyrolyzed-ash precipitator (220) (see FIGS. 1, 2, and 4).

In one embodiment, the present disclosure provides a two-part system in which the gasifier reactor zone (111) of the gasifier reactor (110) is hollow with one side (112) tilting downward and becoming narrower toward the bottom. The gasifier reactor zone (111) comprises: (a) a feedstock loading door (113) with a cone shape opening (113*a*); (b) a grate (114) positioned on the bottom of the zone, with several gasifying agent supply slots (114*a*); (c) a coal (ember) discharge screw (115) positioned under the grate (114) and submerged in the water tank (130); (d) a first gas exit (116) is positioned on the wall opposite to the wall that has the feedstock loading door (113) and is tilted upward; (e) an ash distillation zone (117) of the gasifier reactor (110) that is created on the outer case (118) which is wrapped around the first gas exit (116) of the gasifier reactor zone (111), and that has an open bottom (119) and is submerged in the water tank (130); and (f) a second gas exit (118*a*) also positioned on the outer case (118) to conduct the produced syngas into the pyrolysis system (200), in which the second gas exit (118*a*) is positioned right below the first gas exit (116), in a vertical position.

In another embodiment of the two-part system of the disclosure, the refueling module (120) is positioned at the feedstock loading door (113) and comprises: (a) a feed hopper (121); (b) a helix screw (122) with a shaft (122*a*), which shaft (122*a*) has a cone shape corresponding with the cone shaped feedstock loading door (113); (c) a hydraulic motor (123) to generate the movement of the helix screw (122); and (d) an open/close cylinder (124) of the feedstock loading door (113) that is built to control the shaft (122*a*) of the helix screw (122)

According to another embodiment of the two-part system of the disclosure, the gasifying-agent supply module (140) comprises: (a) a fan (141); (b) a first pipeline (142) with one end connected to the gasification agent supply end of the pyrolysis system (200) and the other end connected to the fan (141); (c) an air valve (143) that is also connected to the fan (141); (d) a second pipeline (144) with one end connected to the other end of the fan (141) and the remaining end connected to the gasifying agent supply slots (114*a*) of grate (114); and (e) a third pipeline (145) with one end connected to the second gas pipeline (144) and the other end connected to the entry of the gasification system (200).

In another embodiment of the two-part system of the disclosure, the gasifier reactor (110) also has a function gate (150) which is positioned on one side of the gasifier reactor (110).

In still another embodiment of the two-part system of the disclosure, the pyrolysis reactor (210) of the pyrolysis system (200) comprises: (a) an internal body (211) with an internal hollow zone (211*a*); (b) an insulation casing (212) comprising an upper hollow zone (212*a*) which wraps around the internal body (211), a lower hollow zone (212*b*) and a fume exhaust door (212*c*) which is positioned on the insulation casing (212); (c) a gas burner (213) that is positioned inside the lower hollow zone (212*b*) of the insulation casing (212) to heat up the internal body (211) from the bottom using the syngas produced from the gasification system (100); and (d) a fourth pipeline (214) with one end connected to the side of the internal body (211) and the other end connected with the pyrolyzed-ash precipitator (220) to conduct the gas-ash mixture from pyrolysis reactor (210) into the pyrolyzed-ash precipitator (220).

In another embodiment of the two-part system of the disclosure, the gas burner (213) has one end connected to the second gas exit (118*a*) of the gasifier reactor (110) and the other end connected to the third pipeline (145).

In another embodiment of the two-part system of the disclosure, the pyrolyzed-ash precipitator (220) is designed with a vertical cylindrical shape, which comprises the precipitator body (221) with cone shaped end (222). The entrance (223) is positioned on top of the precipitator body (221). The exhaust pipe for deposited pyrolyzed ash (224) is connected to the cone shaped end (222) of the condenser (230) which is extended to the water tank (130). The exit for the unsettled pyrolyzed ash (225) is positioned on the upper side near the top of the precipitator body (221).

In another embodiment of the two-part system of the disclosure, the fourth pipeline (214) is positioned on the entrance (223) of the precipitator body (221) which is extended to the center of the precipitator body (221) to allow heavy pyrolyzed-ash to settle and at the same time to prevent the heavy pyrolyzed-ash from moving over to the condenser (230).

In another embodiment of the two-part system of the disclosure, the condenser (230) is designed with a vertical cylindrical shape, which consists of the condenser body (231) with the cone shaped end (232). The entrance of the unsettled pyrolyzed ash (233) is positioned on the upper side near the top of the condenser body (231), which corresponds to and connected with the exit of the unsettled pyrolyzed ash (225) of the pyrolyzed-ash precipitator (220). The gas exit (234) is positioned on the top of the condenser body (231) where one end of the first pipeline (142) is connected. Several cooling pipes (235) are positioned vertically in the condenser body (231). There is an exhaust pipe for liquefied gas (236) that is positioned on the cone shaped end (232) of the condenser (230) and that is extended into the water tank (130).

The presently-disclosed, two-part gasification and pyrolysis system, which can process and use non-homogeneous feedstock, has overcome the problem of excessively-costly energy consumption for pyrolysis. In addition, disclosed system, which comprises a gasification unit (gasifier), and a gasifying-agent supply module along with the water tank that plays a safety control role, can use any homogeneous or any non-homogeneous feedstock for the gasifier.

Moreover, the system of the disclosure is a closed-loop system that is environmentally friendly due to the fact that there will be little to no emission of poisonous gas or pollutants that would be dispersed into the atmosphere. The equipment and system of the disclosure are designed to optimize the function and use of each component of that equipment employing interrelated connections between and among these equipment components, in order to achieve high efficiency with simplified equipment structure and overall system complexity Further areas of applicability of the present invention will become apparent from the detailed description provided hereinafter. It should be understood that the detailed description and specific examples, while indicating preferred embodiments of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION

The following description of the preferred embodiment(s) is merely exemplary in nature and is in no way intended to limit the invention, its application, or uses.

The invention will be described in detail below as preferred embodiments with attached drawings. However, it should be understood that the invention may be amended, modified and/or replaced by professionals in related technical fields as to not deviate from the scope and the nature of the invention. Therefore, the scope of the invention is clearly defined by the attached drawings and by the appended claims.

Figure 1:
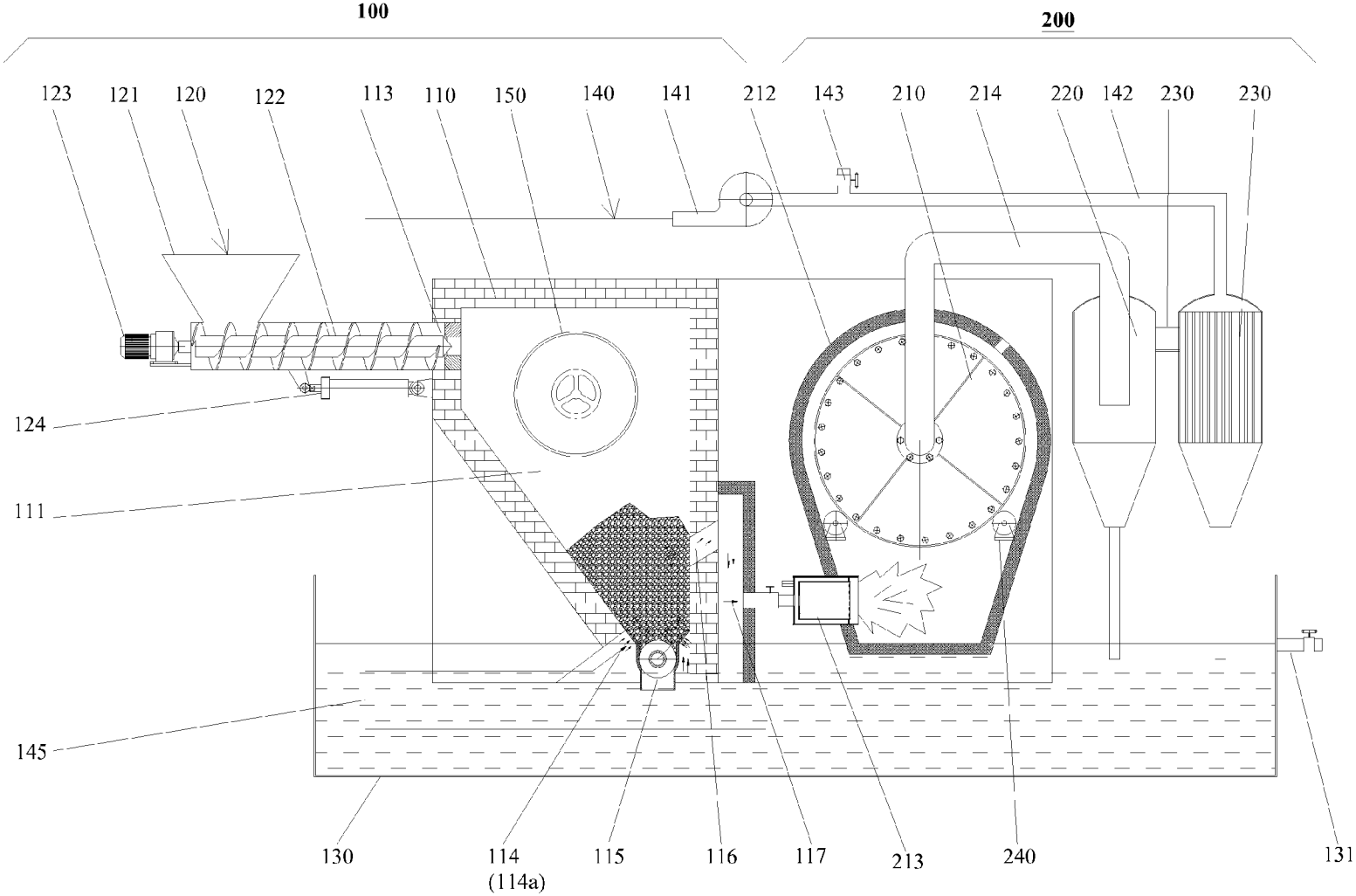
FIG. 1 Depicts a side elevation showing the entire diagram of the medical and hazardous waste treatment system.

As described in FIG. 1, the two-part system for treating medical waste and hazardous waste of the disclosure comprises: a heterogeneous gasification system (100) to produce syngas from non-homogeneous waste, and a pyrolysis system (200) for the pyrolyzing of medical and hazardous waste using the syngas produced from the heterogeneous gasification system (100).

The heterogeneous gasification system (100) comprises: (a) a gasifier reactor (110) with a vertical rectangular shape; (b) a re-fueling structure (120) which is installed on the gasifier reactor (110) to supply feedstock into the gasifier reactor (110); (c) a water tank (130) that plays the role of the safety buffer (safety valve) and which wraps around the entire bottom section of the gasification system (100), which water tank (130) has a top side open to the air; and (d) a gasification-agent supply module (140) with a supply-end connected to the bottom of the gasifier reactor (110) and the demand-end connected to the pyrolysis system (200).

Figure 2:
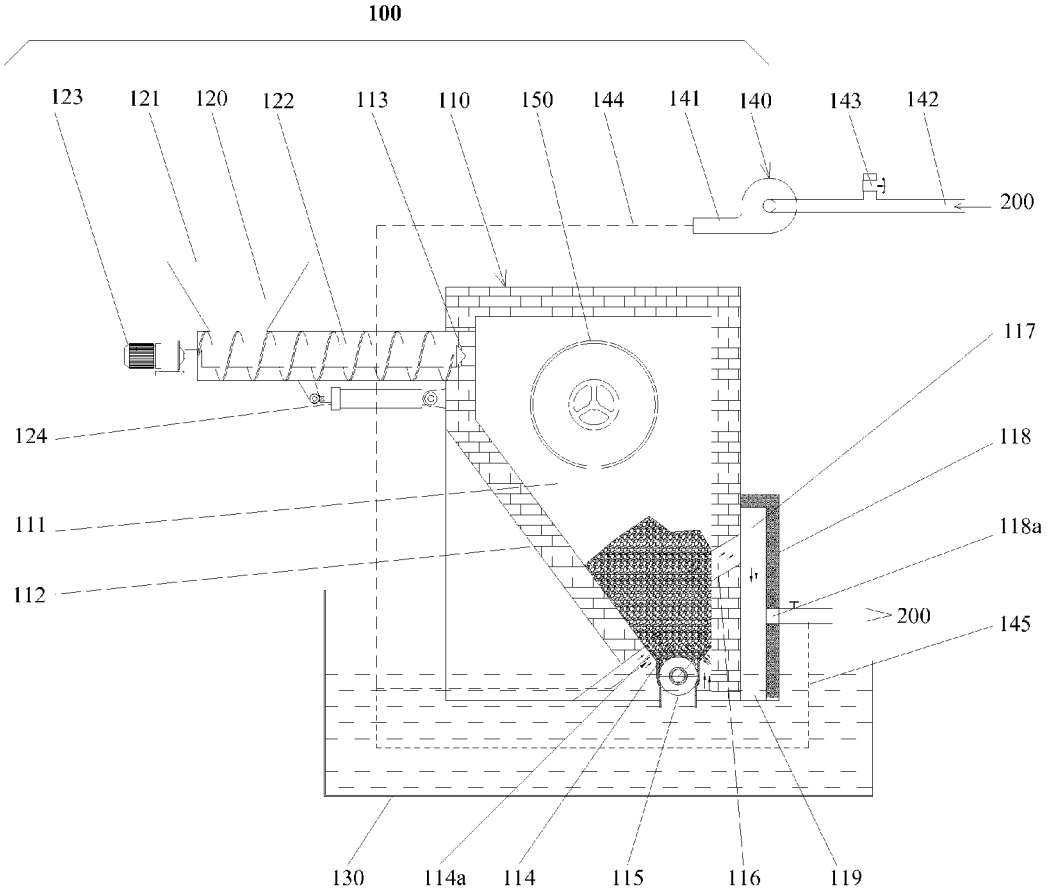
FIG. 2 Depicts the gasification system component of the disclosure.

As described in FIG. 2, the gasifier reactor (110) is built with fire-resistant bricks (refractory bricks) which includes a gasifier reactor zone (111) and an ash-distillation zone (117).

The gasifier reactor zone (111) of the gasifier (110) is made hollow with one side (112) tilting downward and becoming narrower toward the bottom. The gasifier reactor zone (111) comprises: (a) a feedstock loading door (113) with a cone shape opening (113*a*); (b) a grate (114) positioned on the bottom of the zone, with several gasifying agent supply slots (114*a*); (c) a coal (ember) discharge screw (115) positioned under the grate (114) and submerged in the water tank (130); (d) a first gas exit (116) is positioned on the wall opposite to the wall that has the feedstock loading door (113) and is tilted upward to prevent the stagnant flow of or overflow of the feedstock into the ash-distillation zone (117).

The grate (114) of the gasifier reactor (110) is designed in such a way that it could support the burning gasifying feedstock. The grate (114) is designed with several gasifying agent supply slots (114*a*) for the combustion of the feedstock which lays on it.

In addition, the gasifier reactor (110) includes a function gate (150), positioned on the side of zone to help with the maintenance and the start-up of the gasification burning process.

The refueling module (120) is positioned at the feedstock loading door (113) and comprises: (a) a feed hopper (121); (b) a helix screw (122) with a shaft (122*a*), which shaft (122*a*) has a cone shape corresponding with the cone shaped feedstock loading door (113); (c) a hydraulic motor (123) to generate the movement of the helix screw (122); and (d) an open/close cylinder (124) of the feedstock loading door (113) that is built to control the shaft (122*a*) of the helix screw (122), which mechanism plays the open/close function of the feedstock loading door (113).

Figure 3A:
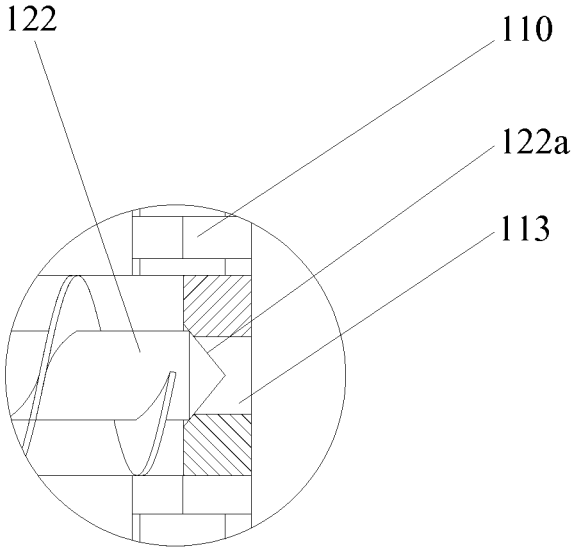
FIG. 3A and FIG. 3B Present enlarged drawings of the open-and-close conditions (positions) of the feedstock loading door of the gasification module.

As described in FIG. 3A, the shaft (122*a*) of the helix screw (122) is assembled tightly on the cone shape opening (113*a*) of the feedstock loading door (113) as a consequence of the cylinder (124) that pulls the helix screw (122) toward the gasifier reactor (110), causing the closing of the feedstock loading door (113).

Figure 3B:
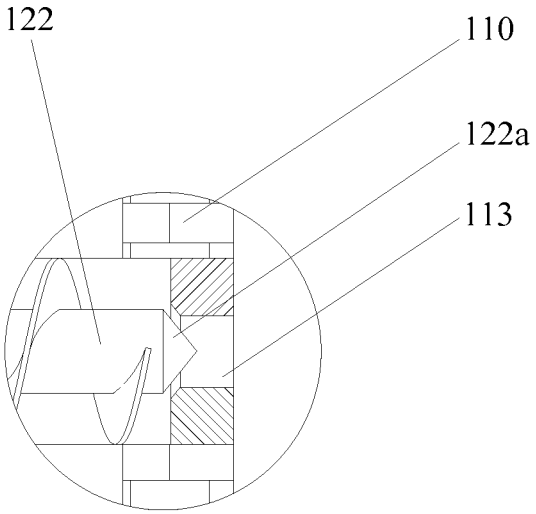

As described in FIG. 3B, the shaft (122*a*) of the helix screw (122) also creates a gap on the cone shape opening (113*a*) of the feedstock loading door (113) as a consequence of the cylinder (124) that pushes the helix screw (122) away from the gasifier reactor (110), causing the opening of the feedstock loading door (113). In this position, feedstock can be loaded into the gasifier reactor (110).

The ash distillation zone (117) of the gasifier reactor (110) is created on the outer case (118) which is wrapped around the first gas exit (116) of the gasifier reactor zone (111). The ash distillation zone (117) has an open bottom (119) and is submerged in the water tank (130).

The second gas exit (118*a*) is also positioned on the outer case (118) to conduct the produced syngas into the pyrolysis system (200), in which the second gas exit (118*a*) is positioned right below the first gas exit (116), in a vertical position.

The gasifying-agent supply module (140) comprises: (a) a fan (141); (b) a first pipeline (142) with one end connected to the gasification agent supply end of the pyrolysis system (200) and the other end connected to the fan (141); (c) an air valve (143) that is also connected to the fan (141) and the other end is open to the open air; (d) a second pipeline (144) with one end connected to the other end of the fan (141) and the remaining end of the second pipeline is connected to the gasifying agent supply slots (114*a*) of grate (114) of the gasifier reactor zone (111); and (e) a third pipeline (145) with one end connected to the second gas pipeline (144) and the other end of the third pipeline is connected to the entry of the pyrolysis system (200) at the gas burner.

Figure 4:
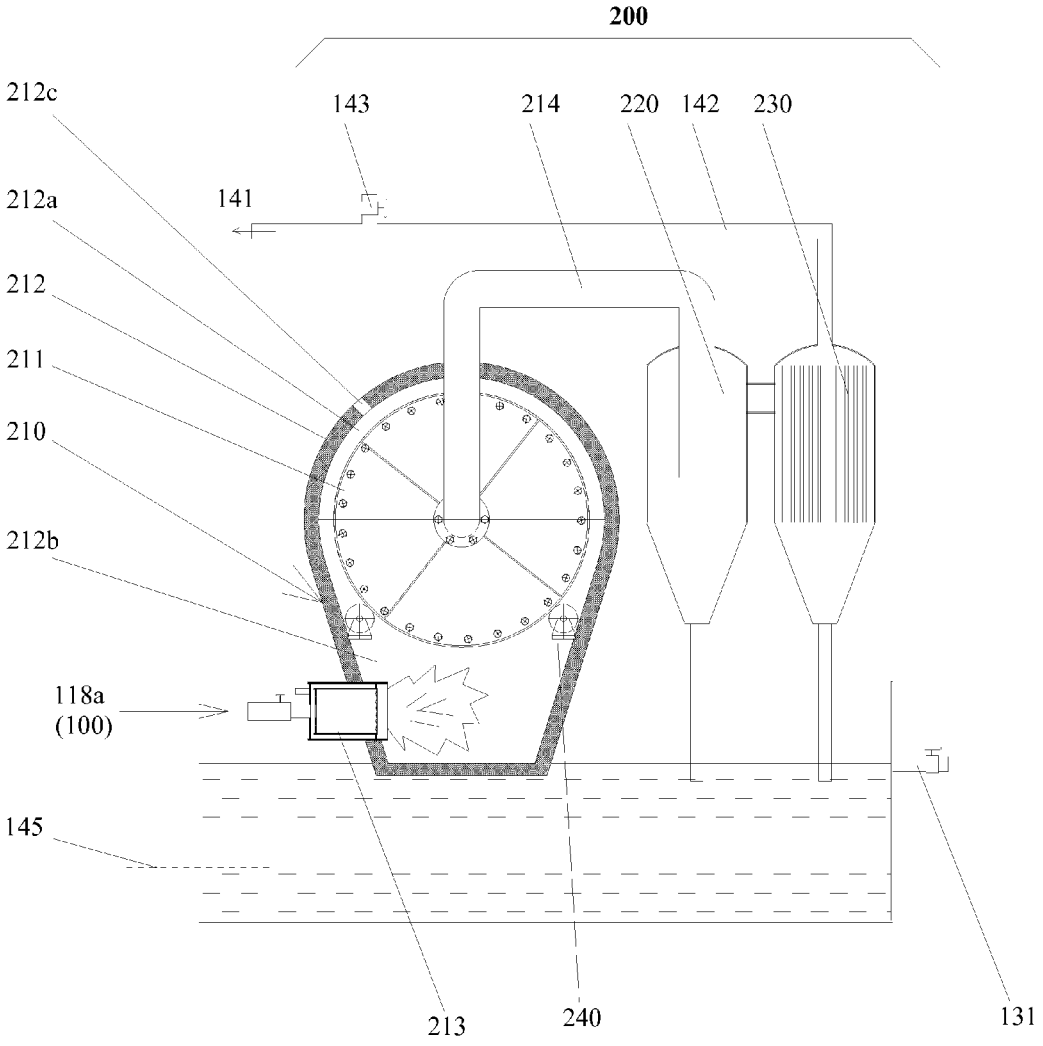
FIG. 4 Depicts the pyrolysis system of the disclosure.

As described on FIG. 1 and FIG. 4, the gasification system (200) comprises: (a) a rotatable pyrolysis reactor (210); (b) a pyrolyzed-ash precipitator (220) which is connected to the pyrolysis reactor (210); and (c) a condenser (230) which is connected to the pyrolyzed-ash precipitator (220).

As described in FIG. 4, the pyrolysis reactor (210) comprises: (a) a horizontal internal body (211) with hollow cylindrical shape which is rotatable by a roller (240); (b) an insulation casing (212) having an upper hollow zone (212*a*) which wraps around the internal body (211), a lower hollow zone (212*b*) and a fume exhaust door (212*c*) which is positioned on the insulation casing (212), which exhaust door (212*c*) is designed to prevent combustion from the gas burner (213) (will be described below); (c) a gas burner (213) that is positioned inside the lower hollow zone (212*b*) of the insulation casing (212) to heat up the internal body (211) from the bottom using the syngas produced from the gasification system (100), which gas burner (213) has one end connected to the second gas exit (118*a*) of the ash distillation zone (117) and the other end connected to the third pipeline (145); (d) a fourth pipeline (214) with one end connected to the side of the internal body (211) and the other end connected with the pyrolyzed-ash precipitator (220) to conduct the dust-ash mixture, which comes from the medical and/or toxic waste after being pyrolyzed in the pyrolysis reactor (210), into the pyrolyzed-ash precipitator (220).

Figure 5:
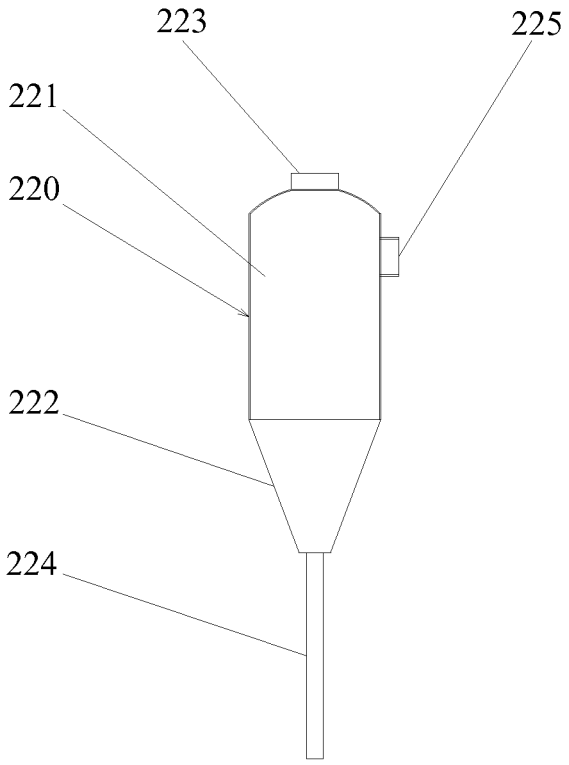
FIG. 5 Depicts the pyrolyzed-ash precipitator of the pyrolysis system.

As described in FIG. 5, the pyrolyzed-ash precipitator (220) is designed with a vertical cylindrical shape, and includes the precipitator body (221) with cone shaped end (222). The entrance (223) is positioned on top of the precipitator body (221) where the fourth pipeline (214) (dust-ash line) passes through the center of the precipitator body (221) to allow heavy gas and ash be settled to the bottom and at the same time to prevent this the heavy pyrolyzed-ash from moving over to the condenser (230). The exhaust pipe for deposited pyrolyzed ash (224) is connected to the cone shaped end (222) of the precipitator body (230) which is extended to the water tank (130). The exit for the unsettled pyrolyzed ash (225) is positioned on the upper side near the top of the precipitator body (221), which is above the upper end of the fourth pipeline (214). This arrangement is designed to allow only light dust and light ash to be moved into the condenser (230).

Figure 6:
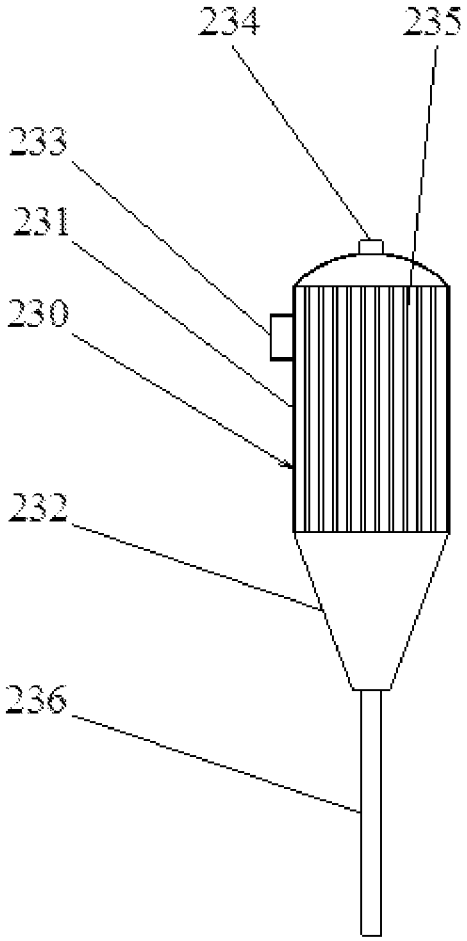
FIG. 6 Depicts the condenser unit of the pyrolysis system.

As described in FIG. 6, the condenser (230) is designed with a vertical cylindrical shape, which includes the condenser body (231) with the cone shaped end (232) to allow the collection of liquefied gas (i.e., oil and water). The entrance of the unsettled pyrolyzed ash (233) is positioned on the upper side near the top of the condenser body (231), which corresponds to and connected with the exit of the unsettled pyrolyzed ash (225) of the pyrolyzed-ash precipitator (220). The gas exit (234) is positioned on the top of the condenser body (231) where one end of the first pipeline (142) is connected to. Several cooling pipes (235) are positioned vertically in the condenser body (231). There is an exhaust pipe for liquefied gas (236) positioned on the cone shaped end (232) of the condenser (230) and is extended into the water tank (130).

The description above provides details of the construction and the main functions of the medical and toxic waste treatment system of the disclosure. All other known sub-functions and their relations are omitted to simplify the explanation of the invention.

The principle functions and operations of the system of the present disclosure are hereby explained below:

1. The process of loading the medical and toxic waste into the pyrolysis reactor (210) by using either manual operation or by conveyor.

2. The process of loading feedstock into the gasifier reactor (110) via the helix screw (122) as well as the process of gasify the feedstock are comprised of:

2.1 Loading and gasifying the feedstock for the first time, meaning loading the RDF pellets (Refuse Derived Fuels—the mixture of inert substance, fiber and any combustible materials) into the gasifier reactor zone (111) of the gasifier reactor (110) via the refueling module (120). First the predetermined volume of RDF pellets are loaded into the feed hopper (121) and are pushed downward to the gasifier reactor zone (111) with the helix screw mechanism (122). The pellets are now gathered on the grate (114) which is situated partially tilting on one side (112) (See FIG. 1 and FIG. 2). When the RDF pellets are being loaded the open/close cylinder (124) will push the shaft (122*a*) away from the gasifier reactor (110) thus creating a gap between the shaft (122*a*) and the cone-shape opening (113*a*) of the feedstock loading door (113). This operation allows the RDF pellets to travel through this gap and into the gasifier reactor zone (111) (see FIG. 3B). The RDF pellets are now being gasified into a embers. The structure gate (150) is now open to allow the burning of the RDF pellets and at the same time the fan (141) is activated to supply air (from outside) through the gasifying agent supply slots (114*a*) of the grate (114) via air valve (143). This function turns RDF pellets into embers on the grate (114) and the structure gate (150) is now closed.

2.2 Loading and gasifying the feedstock for the second time, meaning loading the predetermined volume of RDF pellets into the gasifier reactor zone (111) of the gasifier reactor (110) via the re-fueling module (120) to fill up the gasifier reactor zone (111). At this time the open/close cylinder (124) will pull the shaft (122*a*) toward the gasifier reactor (110) causing the shaft (122*a*) to be tightly closed against the cone-shape opening (113*a*) of the feedstock loading door (113). The process of gasification creates synthetic gas (syngas). Air can be added into the gasifier reactor zone (111) through the gasifying agent supply slots (114*a*) on the grate (114) via air valve (143). This function increases the spinning of fan (141) and syngas is produced at the gas burner (213) of the pyrolysis system (200). Air supply can be regulated via valve (143) to adjust the spinning of fan (141) as desired. When all RDF pellets have been gasified, coals (i.e., embers) can be discharged into the water tank (130) with the "coal" (ember) discharge screw (115).

3. The process of transferring synthetic gas (syngas): After syngas is produced in the gasifier reactor zone (111) syngas will travel into the ash-distillation zone (117) via the first gasification exit (116) due the difference of pressure between these two zones. In the ash-distillation zone (117) all ash will be settled downward to the water tank (130) due to its weight leaving the syngas to continue moving into the gas burner (213) of the pyrolysis system (200). However, before moving into the gas burner (213) the syngas is to be mixed with more air which is supplied from the third pipeline (145). If the volume of syngas produced in the gasifier reactor zone (111) is considered large (causing too large a pressure) the gasifier reactor could possibly explode. However, due to the gaps designed for the ash-distillation zone (117) which is submerged into the water tank (130) the undesired large volume of syngas in the gasifier reactor zone (111) will be released into the water tank (130). This means the pressure caused by the syngas will be released in the water tank (130) and then into the open air. The water tank (130) plays as safety function role for the gasification system (water buffer).

4. The process of pyrolysis. First, fire is ignited at gas burner (213) creating a somewhat white-blue flame which generates heat at the gas burner (213). The heat can be adjusted by the open/close air valve (143) and by an increase/decrease in the speed of fan (141). At this time, the pyrolysis reacting process is occurring in the internal body (211) of the pyrolysis reactor (210) which is rotated by the roller (240). The hydrocarbon structure in medical waste or toxic waste is broken up in this process. Any smoke produced by the gas burner (213) in the lower hollow zone (212*b*) is taken outside (vented) through the fume exhaust gate (212*c*).

5. The process of precipitating pyrolyzed ash (heavy gas and gash). The mixture of pyrolyzed gas-ash in the pyrolysis reactor (210) is sucked out and moved into the pyrolyzed-ash precipitator (220) via the fourth pipeline (214). This is achieved due the difference in pressure. At this, via gravity, any heavy gas or ash in the mixture of pyrolyzed gas is settled into the water tank (130) through the exhaust pipe for deposited pyrolyzed ash (224). Meanwhile the unsettled pyrolyzed ash (lighter ash) is being moved into the condenser (230) via the exit for unsettled pyrolyzed ash (225). Specifically, the fourth pipeline (214) is designed with the pipe extended down through the center of the pyrolyzed-ash precipitator (220) and the exit (225) is positioned near the top allowing the heavy gas and heavy dust to be settled downward while the lighter gas is moved to the condenser (230).

6. The process of condensing of the unsettled gas and ash. The mixture of unsettled pyrolyzed gas-ash is moved to the condenser (230) through entrance (233) and is chilled down by several cooling pipes (235). This mixture is condensed into a liquid form (synthetic oil) and drawn through the exhaust pipe for condensable liquid gas (236) into the water tank (130). The mixture can be seen afloat on the water tank (130). Meanwhile during this period the combustible gas (syngas) is taken through exit (234) into the first pipeline (141) and to the grate (141) and the entrance of the gas burner (213) via fan (141). In addition, the condensable liquid gas (236) afloat on the water tank (130) is taken outside through valve (131).

Although the invention has been described through certain, preferred embodiments with reference to accompanying drawings, it is understood that the invention may be amended, modified and replaced under the equivalent nature of the invention by those skilled in the art and nature of the invention. Thus the scope of the invention is defined by the attached claims.

What is claimed is:

1. A two-part gasification and pyrolysis optimization system for treatment of toxic waste comprising:

(a) a heterogeneous gasification system to produce syngas from non-homogeneous waste; and (b) a pyrolysis system for the pyrolyzing of medical and hazardous waste using the syngas produced from the heterogeneous gasification system, wherein the pyrolysis system comprises:

(a) a pyrolysis reactor having a horizontal and hollow cylindrical shape which is rotatable by a roller;

(b) a pyrolyzed-ash precipitator which is connected to a pyrolysis reactor zone; and (c) a condenser (230) connected to the pyrolyzed-ash precipitator wherein the pyrolyzed-ash precipitator has a vertical cylindrical shape and comprises a precipitator body having a cone shaped lower end, an entrance disposed on the top of the precipitator body, an exhaust pipe for deposited pyrolyzed ash connected to a condenser and which exhaust pipe is extended to the water tank, and an unsettled pyrolyzed ash exit disposed on the upper side near the top of the precipitator body, wherein a fourth pipeline is disposed on the entrance of the precipitator body and is extended to the center of the precipitator body to a position allowing heavy pyrolyzed-ash to settle while minimizing heavy pyrolyzed-ash transfer to the condenser, wherein the condenser has a vertical cylindrical shape, and comprises a condenser body having a cone shaped lower end, an entrance for unsettled pyrolyzed ash positioned on the upper side near the top of the condenser body, said entrance connected to the exit of the unsettled pyrolyzed ash of the pyrolyzed-ash precipitator, and a gas exit positioned on the top of the condenser body said exit connected to the second end of the first pipeline.

2. The system of claim 1, wherein the condenser is in operative connection with a plurality of cooling pipes disposed vertically in the condenser body, and wherein the condenser further comprises an exhaust pipe for liquefied gas disposed on the cone shaped end of the condenser and extended into the water tank.

3. A two-part gasification and pyrolysis optimization system for treatment of toxic waste comprising:

(a) a heterogeneous gasification system to produce syngas from non-homogeneous waste; and (b) a pyrolysis system for the pyrolyzing of medical and hazardous waste using the syngas produced from the heterogeneous gasification system, wherein the heterogeneous gasification system comprises a gasifier reactor having a vertical rectangular shape, which gasifier reactor comprises a gasifier reactor zone connected with an ash distillation zone, a re-fueling structure, and a water tank, which water tank wraps around the entire bottom section of the gasification system and has a top side open to the air, wherein the gasifier reactor zone is hollow with one side tilting downward and becoming narrower toward the bottom, wherein the gasifier reactor zone further comprises:

(a) a feedstock loading door with a cone shape opening;

(b) a grate positioned on the bottom of the zone, with a plurality of gasifying agent supply slots; and (c) a coal (ember) discharge screw positioned under the grate and submerged in a water tank;

and the system further comprising:

(a) a first gas exit positioned on the wall opposite to the wall that has the feedstock loading door and is tilted upward;

(b) an ash distillation zone of the gasifier reactor disposed on the outer case thereof and which is wrapped around the first gas exit of the gasifier reactor zone, and having an open bottom is submerged in the water tank; and (c) a second gas exit disposed on the outer case of the gasifier reactor, said second gas exit conducting produced syngas into the pyrolysis system, and wherein the second gas exit is positioned below the first gas exit in a vertical position.

4. A two-part gasification and pyrolysis optimization system for treatment of toxic waste comprising:

(a) a heterogeneous gasification system to produce syngas from non-homogeneous waste; and (b) a pyrolysis system for the pyrolyzing of medical and hazardous waste using the syngas produced from the heterogeneous gasification system, wherein the heterogeneous gasification system comprises a gasifier reactor having a vertical rectangular shape, which gasifier reactor comprises a gasifier reactor zone connected with an ash distillation zone, a re-fueling structure, and a water tank, which water tank wraps around the entire bottom section of the gasification system and has a top side open to the air, wherein the heterogeneous gasification system further comprises a gasification-agent supply module having a supply-end connected to the bottom of the gasifier reactor and a demand-end connected to the pyrolysis system, and wherein the gasifying-agent supply module comprises:

(a) a fan;

(b) a first pipeline with a first end connected to a gasification agent supply end of the pyrolysis system and a second end connected to the first side of the fan;

(c) an air valve connected to the fan;

(d) a second pipeline having a first end connected to a second side of the fan and a second end connected to gasifying agent supply slots of a grate; and (e) a third pipeline having a first end connected to the second gas pipeline and a second end connected to an entry of the pyrolysis system.

5. The system of claim 4, wherein the toxic waste is hazardous waste or medical waste.

6. The system of claim 4, wherein the gasifier reactor comprises a function gate disposed on one side of the gasifier reactor.

7. The system of claim 4, wherein the gasifier reactor zone is hollow with one side tilting downward and becoming narrower toward the bottom.

8. The system of claim 7, wherein the gasifier reactor zone further comprises:

(a) a feedstock loading door with a cone shape opening;

(b) a grate positioned on the bottom of the zone, with a plurality of gasifying agent supply slots; and (c) a coal (ember) discharge screw positioned under the grate and submerged in a water tank.

9. The system of claim 8, further comprising a refueling module disposed at the feedstock loading door.

10. The system of claim 4, wherein the pyrolysis system comprises:

(a) a pyrolysis reactor having a horizontal and hollow cylindrical shape which is rotatable by a roller;

(b) a pyrolyzed-ash precipitator which is connected to a pyrolysis reactor zone; and (c) a condenser (230) connected to the pyrolyzed-ash precipitator.

11. The system of claim 10, wherein the pyrolysis reactor comprises:

(a) an internal body with an internal hollow zone;

(b) an insulation casing comprising an upper hollow zone that wraps around the internal body, a lower hollow zone, and a fume exhaust door disposed on and through the insulation casing;

(c) a gas burner disposed on the inside of the lower hollow zone of the insulation casing, said burner burning syngas produced from the gasification system and heating the internal body from below;

(d) a fourth pipeline with a first end connected to a side of the internal body and a second end connected to a pyrolyzed-ash precipitator, the fourth pipeline conducting gas-ash mixture from the pyrolysis reactor into the pyrolyzed-ash precipitator.

12. The system of claim 11, wherein the gas burner has a first end connected to a second gas exit of the gasifier reactor a second end connected to a third pipeline.

13. The system according to claim 10, wherein the pyrolyzed-ash precipitator has a vertical cylindrical shape and comprises a precipitator body having a cone shaped lower end, an entrance disposed on the top of the precipitator body, an exhaust pipe for deposited pyrolyzed ash connected to a condenser and which exhaust pipe is extended to the water tank, and an unsettled pyrolyzed ash exit disposed on the upper side near the top of the precipitator body.

14. The system according to claim 13, wherein a fourth pipeline is disposed on the entrance of the precipitator body and is extended to the center of the precipitator body to a position allowing heavy pyrolyzed-ash to settle while minimizing heavy pyrolyzed-ash transfer to the condenser.

15. A two-part gasification and pyrolysis optimization system for treatment of toxic waste comprising:

(a) a heterogeneous gasification system to produce syngas from non-homogeneous waste; and (b) a pyrolysis system for the pyrolyzing of medical and hazardous waste using the syngas produced from the heterogeneous gasification system, wherein the heterogeneous gasification system comprises a gasifier reactor having a vertical rectangular shape, which gasifier reactor comprises a gasifier reactor zone connected with an ash distillation zone, a re-fueling structure, and a water tank, which water tank wraps around the entire bottom section of the gasification system and has a top side open to the air, wherein the gasifier reactor zone is hollow with one side tilting downward and becoming narrower toward the bottom, wherein the gasifier reactor zone further comprises:

(a) a feedstock loading door with a cone shape opening;

(b) a grate positioned on the bottom of the zone, with a plurality of gasifying agent supply slots; and (c) a coal (ember) discharge screw positioned under the grate and submerged in a water tank;

further comprising a refueling module disposed at the feedstock loading door, wherein the refueling module comprises:

(a) a feed hopper;

(b) a helix screw with a shaft, said shaft having a cone shape corresponding to the cone shaped feedstock loading door;

(c) a hydraulic motor to generate the movement of the helix screw; and (d) an open/close cylinder of the feedstock loading door controlling the shaft of the helix screw.

* * * * *